US009431022B2

(12) United States Patent
Kumagai et al.

(10) Patent No.: US 9,431,022 B2
(45) Date of Patent: Aug. 30, 2016

(54) SEMICONDUCTOR DEVICE AND VOICE COMMUNICATION DEVICE

(71) Applicant: Renesas Electronics Corporation, Kawasaki-shi, Kanagawa (JP)

(72) Inventors: Michi Kumagai, Kanagawa (JP); Tetsuya Nakagawa, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 306 days.

(21) Appl. No.: 13/766,329

(22) Filed: Feb. 13, 2013

(65) Prior Publication Data

US 2013/0211831 A1 Aug. 15, 2013

(30) Foreign Application Priority Data

Feb. 15, 2012 (JP) ..... 2012-030384

(51) Int. Cl.

| | |
|---|---|
| ***G10L 21/00*** | (2013.01) |
| ***G10L 21/02*** | (2013.01) |
| ***G10L 21/0208*** | (2013.01) |
| *G10L 25/93* | (2013.01) |

(52) U.S. Cl.

CPC ..... *G10L 21/02* (2013.01); *G10L 21/0208* (2013.01)

(58) Field of Classification Search

CPC ..... G10L 2021/02161; G10L 21/0208; G10L 21/0216; G10L 21/0232; G10L 19/26; G10L 21/0364

USPC ..... 358/226, 233, 206

See application file for complete search history.

(56) References Cited

U.S. PATENT DOCUMENTS

| | | | | |
|---|---|---|---|---|
| 8,175,145 | B2 | 5/2012 | Garcia et al. | |
| 2006/0195316 | A1 | 8/2006 | Sakuraba | |
| 2008/0219473 | A1* | 9/2008 | Sugiyama et al. | 381/94.4 |
| 2010/0183067 | A1* | 7/2010 | Garcia | G10L 19/26 375/240 |

FOREIGN PATENT DOCUMENTS

| | | | |
|---|---|---|---|
| JP | H10 171497 | A | 6/1998 |
| JP | 2001-265367 | A | 9/2001 |

OTHER PUBLICATIONS

Official action dated Aug. 6, 2015 issued in Japanese counterpart applicatin (No. 2012-030384) with translation.

* cited by examiner

*Primary Examiner* — Thierry L Pham
(74) *Attorney, Agent, or Firm* — Womble Carlyle

(57) ABSTRACT

A semiconductor device for realizing higher-precision noise elimination includes: a decoder which decodes an encoded input signal; a determining unit which determines whether or not a voice signal is included in the input signal; a suppressor which performs a suppressing process for suppressing a noise component included in the input signal on the basis of a result of determination by the determining unit; and a first storage for storing, as a determination criterion value used for the determination, a first criterion value which specifies the proportion of a voice signal with respect to voice distortion noise.

19 Claims, 12 Drawing Sheets

FIG. 4

| N/S ADJUSTMENT MODE SIGNAL (PARAMETER VALUE) | BACKGROUND NOISE DETERMINATION REFERENCE (SNR1) | |
|---|---|---|
| 0 | SNR1_0 (=45dB) | QUIET ROOM |
| 1 | SNR1_1 (=22dB) | NORMAL ROOM, COFFEE SHOP, OR THE LIKE |
| 2 | SNR1_2 (=xx dB) | ON THE ROAD |
| 3 | SNR1_3 (=xx dB) | IN THE CAR |
| · | · | · |
| · | · | · |
| · | · | · |
| n | SNR1_n (=6dB) | BIG NOISE |

FIG. 5

| PARTICULAR NOISE SELECTION SIGNAL (PARAMETER VALUE) | PARTICULAR NOISE DETERMINATION REFERENCE (SNR2) | |
|---|---|---|
| 0 | SNR2_0 (=xx dB) | CODEC METHOD: AMR |
| 1 | SNR2_1 (=xx dB) | CODEC METHOD: G.726(16kbit/s) |
| 2 | SNR2_2 (=xx dB) | CODEC METHOD: G.726(24kbit/s) |
| 3 | SNR2_3 (=xx dB) | · |
| 4 | SNR2_4 (=xx dB) | · |
| 5 | SNR2_5 (=xx dB) | CALL MODE WHEN MASK IS USED |
| 6 | SNR2_6 (=xx dB) | CALL MODE WHEN USER WEARS HELMET |
| · | · | · |
| · | · | · |
| · | · | · |
| m | SNR2_m (=xx dB) | ORIGINAL CALL MODE |

FIG. 6

```
const short Noise_table[81]=
{
    a, b, c, c, c, c, c, c, c, c,
    d, d, d, d, d, d, d, d, d, d,
    d, d, d, d, d, d, d, d, d, d,
    d, d, d, d, d, d, d, d, d, d,
    d, d, d, d, d, d, d, d, d, d,
    d, d, d, d, d, d, d, d, d, d,
    e, e, e, e, e, e, e, e, e, e,
    e, e, e, e, e, e, e, e, f, f,
    f
};
```

FIG. 7

| PARTICULAR NOISE SELECTION SIGNAL (PARAMETER VALUE) | PARTICULAR NOISE TABLE (NT2) | |
|---|---|---|
| 0 | NT2_0 | CODEC METHOD: AMR |
| 1 | NT2_1 | CODEC METHOD: G.726(16kbit/s) |
| 2 | NT2_2 | CODEC METHOD: G.726(24kbit/s) |
| 3 | NT2_3 | · |
| 4 | NT2_4 | · |
| 5 | NT2_5 | CALL MODE WHEN MASK IS USED |
| 6 | NT2_6 | CALL MODE WHEN USER WEARS HELMET |
| · | · | · |
| · | · | · |
| · | · | · |
| m | NT2_m | ORIGINAL CALL MODE |

SEMICONDUCTOR DEVICE AND VOICE COMMUNICATION DEVICE

CROSS-REFERENCE TO RELATED APPLICATIONS

The disclosure of Japanese Patent Application No. 2012-030384 filed on Feb. 15, 2012 including the specification, drawings and abstract is incorporated herein by reference in its entirety.

TECHNICAL FIELD

The present invention relates to a semiconductor device and a voice communication device and, more particularly, to a technique for eliminating noise from an input signal including a voice signal and noise.

BACKGROUND ART

In a voice communication device such as a cellular phone or a telephone conference system, it is very important to reduce noise. Many voice communication devices, such as cellular phones, employ a technique for removing background noise (ambient noise). For example, patent literatures 1 and 2 disclose background arts for removing background noise from an input signal containing a voice signal and background noise.

Patent literature 1 discloses a noise eliminating technique, to eliminate background noise without deteriorating sound quality, of eliminating estimated background noise obtained by eliminating a sharp change component of background noise from an input signal and eliminating re-updated estimated background noise including the sharp change component of the background noise in a frequency band having low S/N ratio. Patent literature 2 discloses a technique, in a background noise eliminating device, for eliminating background noise from a signal containing a voice signal and background noise, of determining whether a present frame signal is in a voice interval or a noise interval on the basis of an S/N ratio for each band calculated on the basis of the bandwidth spectrum in a past noise interval.

Patent Literature 1: Japanese Unexamined Patent Application Publication No. H10-171497

Patent Literature 2: Japanese Unexamined Patent Application Publication No. 2001-265367

SUMMARY OF THE INVENTION

Problem to be Solved by the Invention

In a device of eliminating background noise, in many cases, a process of detecting whether or not a voice signal is included in an input signal (hereinbelow, also called noise determining process) is performed and, after that, a process of discriminating voice and noise and suppressing the noise is performed. In the noise determining process, for example, whether or not a voice signal is include in an input signal is determined by using a determination criterion for determining whether sound is voice or noise. Conventionally, the determination criterion used for the determination is determined on the basis of background noise. For example, in a noise suppressor to which an existing echo canceller technique of a cellular phone is applied, the determination criterion used for the noise determining process is determined on the basis of the S/N ratio (for example, 22 dB) of an input signal to a background noise in general use environment in assumed use environments.

On the other hand, the sound quality at the time of communication of a voice communication device deteriorates due to linear noise (noise of additivity) such as background noise and, in addition, distortion of a voice signal itself caused by encoding of the voice signal and distortion of a voice signal itself caused by an obstacle (for example, a mask, a helmet, or the like) existing between a speaker and a microphone. The inventors of the present invention found out that, in the case of performing the noise determining process using a determination criterion determined in consideration of only background noise on an input signal containing noise other than the background noise, there is the possibility that voice is erroneously determined as noise. For example, in the case where a voice signal deteriorates due to encoding of low bit rate by a codec and noise other than background noise becomes larger than assumed background noise, when the noise determining process is performed using the determination criterion determined on the basis of assumed background noise, voice is erroneously determined as noise, and there is the possibility that voice is inadvertently suppressed. For example, in the case where noise other than background noise exists in call voice and the S/N ratio of voice other than noise is 17 dB, when noise determining process is performed using noise determination criterion (22 dB) determined on the basis of the background noise, an input signal in the range of 17 dB and 22 dB may be determined as noise although the possibility that the input signal includes a voice signal is high. The noise based on the distortion of the voice signal (hereinafter "voice distortion noise") is not considered in the patent literature 2.

The inventors of the present invention thought that, even if the technique described in the patent literature 1 is applied and the process of suppressing noise in the input signal is performed, the noise component other than background noise cannot be suppressed, so that it is insufficient for noise elimination.

An object of the present invention is to provide a technique for realizing higher-precision noise elimination.

The above and other objects and novel features of the present invention will become apparent from the description of the specification and the appended drawings.

Outline of a representative one of inventions disclosed in the specification will be briefly described as follows.

A semiconductor device as an embodiment of the present invention includes: a decoder which decodes an encoded input signal; a determining unit which determines whether or not a voice signal is included in the input signal; a suppressor which performs a suppressing process for suppressing a noise component included in the input signal on the basis of a result of determination by the determining unit; and a first storage for storing, as a determination criterion value used for the determination, a first criterion value which specifies the proportion of a voice signal with respect to noise, based on distortion of the voice signal.

Effect of the Invention

An effect obtained by the representative one of the inventions disclosed in the specification will be briefly described as follows.

By the semiconductor device, higher-precision noise elimination can be realized.

BRIEF DESCRIPTION OF THE DRAWINGS

FIG. 4 is an explanatory diagram illustrating kinds of background noise determination criterion values SNR1.

FIG. 5 is an explanatory diagram illustrating kinds of particular noise determination criterion values SNR2.

FIG. 6 is an explanatory diagram illustrating a particular noise table.

FIG. 7 is an explanatory diagram illustrating kinds of the particular noise tables, each able corresponding to a type of voice distortion noise.

DETAILED DESCRIPTION

1. Outline of Embodiments

Figure 1:
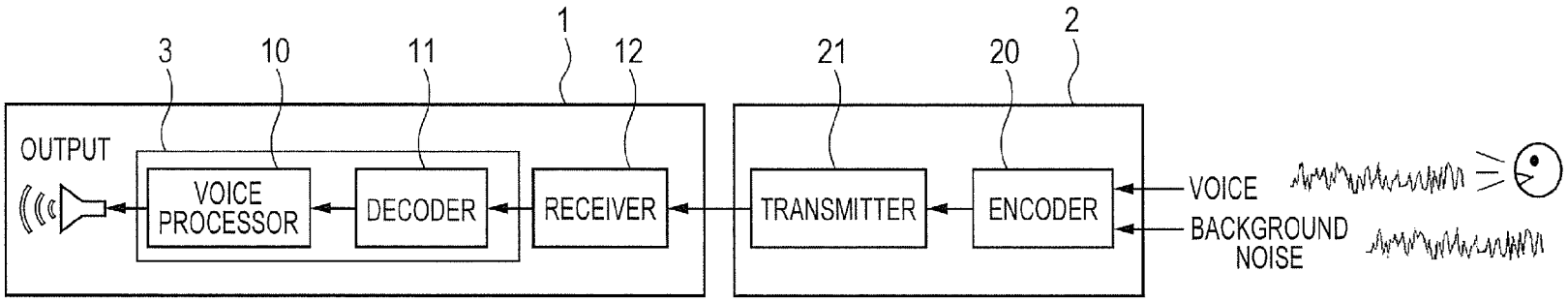
FIG. 1 is an explanatory diagram illustrating a cellular phone terminal in which a voice processing device performs a noise suppressing process for suppressing a noise component included in an input signal at the time of reproducing voice.

First, outline of representative embodiments of the invention disclosed in the application will be described. Reference numerals in the drawings which are referred to in parentheses in explanation of the outline of the representative embodiments indicate components included in the concept of the component to which the reference numerals are designated.

[1] Semiconductor Device for Detecting Voice in Consideration of Noise Caused by Distortion in Voice A semiconductor device (3) as a representative embodiment of the present invention includes: a decoder (11) which decodes an encoded input signal; a determining unit (1001, 4001) which determines whether or not a voice signal is included in the input signal; and a suppressor (1002, 1003) which performs a suppressing process for suppressing a noise component included in the input signal decoded by the decoder on the basis of a result of determination by the determining unit. The semiconductor device also has a first storage (107, 208) for storing, as a determination criterion value used for the determination, a first criterion value (SNR2) which specifies the proportion of a voice signal with respect to noise (particular noise) based on distortion of the voice signal.

In the semiconductor device of [1], the first criterion value can be used as a determination criterion value for the determination. Consequently, for example, even in the case where noise based on distortion in the voice signal, i.e., voice distortion noise, is larger than assumed background noise, the probability of erroneously determining that the voice signal is noise becomes lower than the case of using a determination criterion value in which only background noise is considered. Thus, precision of noise elimination can be increased.

[2] Selection of Smallest Criterion Value as Determination Criterion

The semiconductor device of [1] further includes: a second storage (105, 208) for storing, as a determination criterion value for determination by the determining unit, a second criterion value (SNR1) which specifies the proportion of a voice signal with respect to background noise; and a selector (108) which selects the smaller of the first criterion value (SNR2) stored in the first storage and the second criterion value (SNR1) stored in the second storage, and outputs the smaller value as a selected noise determination reference value. In the semiconductor device of [1], the determining unit makes the determination using the criterion value selected by the selector.

In such a manner, a determination criterion value adapted to the determination is easily selected in accordance with the reference values set in the first and second storages.

[3] Dynamic Determination of Determination Criterion According to Loudness of Background Noise The semiconductor device of [2] further includes an updater (304) which calculates the second criterion value on the basis of a signal level of background noise included in the decoded input signal and updates the value in the second storage.

With the configuration, even in the case where the signal level of background noise included in an input signal changes, the determination criterion value adapted to the determination can be selected.

[4] Determining Method

In the semiconductor device of [2] or [3], in the case where the signal level of the input signal is higher than a determination threshold (noise level×noise determination criterion SNR) determined on the basis of the determination criterion value, the determining unit determines that a voice signal is included in the input signal and, in the case where the signal level of the input signal is lower than the determination threshold, the determining unit determines that no voice signal is included in the input signal.

[5] Process for Suppressing Background Noise and Voice Distortion Noise from Signal Containing Voice In the semiconductor device in any of [1] to [4], the suppressor performs (i) a process for suppressing the background noise on an input signal determined by the determining unit to be an input signal containing a voice signal and (ii) a process for suppressing voice distortion noise.

With the configuration, not only background noise but also voice distortion noise is suppressed. Thus, sound quality can be further improved.

[6] Criterion Value (Noise Table) Used for Suppressing Process

The semiconductor device in any of [1] to [5] further includes: a third storage (103) for storing a third criterion value (background noise table) as a criterion of a background noise suppression amount; and a fourth storage (109) for storing a fourth criterion value (particular noise table) as a criterion of a suppression amount of voice distortion noise. In the semiconductor, in the case where the determining unit determines that a voice signal is included, the suppressor performs a process of subtracting a first suppression amount according to the third criterion value and subtracting a second suppression amount according to the fourth criterion value from the input signal. In the case where the determining unit determines that a voice signal is not included, the suppressor performs a process of subtracting only the first suppression amount according to the third criterion value from the input signal.

With the configuration, voice distortion noise, when present, can be easily suppressed in addition to background noise.

[7] Suppression of Voice Distortion Noise in Voiced Sound

In the semiconductor device of [5] or [6], the suppressor performs a process of subtracting a first suppression amount according to the third criterion value and a second suppression amount according to the fourth criterion value from an input signal containing a voice signal of voiced sound from among a plurality of input signals, each of which is determined by the determining unit (4001) to be an input signal containing a voice signal.

With the configuration, suppression of noise according to the fourth criterion value is not performed on voiceless sound. Consequently, even in the case where voice distortion noise has a signal waveform close to that of voiceless sound, no adverse influence is exerted on the voice signal containing the voiceless sound.

[8] Noise According to Coding Method of Voice

In the semiconductor device in any of [1] to [7], voice distortion noise is noise based on the encoding.

Since noise suppression can be performed in consideration of not only background noise but also noise based on coding of a codec, even in the case where the bit rate of coding by a codec is low and distortion of a voice signal is large, the sound quality can be further improved.

[9] Voice Communication Device Detecting Voice in Consideration of Voice Distortion Noise A voice communication device (1) according to a representative embodiment of the present invention includes: a receiver (12) for receiving an encoded input signal: a decoder (11) which decodes the input signal received by the receiver; and a suppression processor (100, 400) which performs a process for suppressing noise included in the input signal decoded by the decoder. The suppression processor includes: a determining unit (1001) for determining whether or not a voice signal is included in the input signal; a suppressor (1002, 1003) for performing a suppressing process for suppressing a noise component included in the input signal on the basis of a result of determination by the determining unit; and a first storage (107, 208) for storing, as a determination criterion value used for the determination, a first criterion value (SNR2) which specifies the proportion of a voice signal with respect to voice distortion noise.

With the configuration, in a manner similar to [1], the precision of noise elimination by the voice communication device can be increased.

[10] Selection of Smallest Criterion Value as Determination Criterion

In the voice communication device of [9], the suppression processor further includes: a second storage (105) for storing, as a determination criterion value for determination by the determining unit, a second criterion value (SNR1) which specifies the proportion of a voice signal with respect to background noise; and a selector (108) which selects smaller one of the first criterion value stored in the first storage and the second criterion value stored in the second storage, and outputs the smaller of these as a selected noise determination reference value. The determining unit makes the determination using the selected noise determination reference value.

With the configuration, in a manner similar to [2], a determination criterion value adapted to the determination can be selected.

[11] Dynamic Determination of Determination Criterion According to Loudness of Background Noise In the voice communication device of [10], the suppression processor further includes an updater (304) which calculates the second criterion value on the basis of a signal level of background noise included in the decoded input signal and updates the value in the second storage.

With the configuration, in a manner similar to [3], a determination criterion value adapted to the determination can be selected.

[12] Determining Method

In the voice communication device of [10] or [11], in the case where the signal level of the input signal is higher than a determination threshold (noise level×noise determination criterion SNR) determined on the basis of the determination criterion value, the determining unit determines that a voice signal is contained in the input signal. In the case where the signal level of the input signal is lower than the determination threshold, the determining unit determines that no voice signal is contained in the input signal. However, even in the case where the signal level of the input signal is lower than the determination threshold, if it is further determined that a voice signal is contained in the determination result on the time axis, it is determined that a voice signal is contained in the input signal.

[13] Process of Suppressing Background Noise and Voice Distortion Noise from Signal Containing Voice In the voice communication device in any of [9] to [12], the suppressor performs a process for suppressing the background noise in an input signal determined by the determining unit to be an input signal containing a voice signal and a process for suppressing voice distortion noise.

With the configuration, not only the background noise but also voice distortion noise is suppressed. Thus, the sound quality can be further improved.

[14] Criterion Value Used for Suppressing Process

In any of the voice communication devices of [9] to [13], the suppression processor further includes: a third storage (103) for storing a third criterion value (background noise table) as a reference of a background noise suppression amount; and a fourth storage (109) for storing a fourth criterion value (particular noise table) as a reference of a suppression amount of voice distortion noise. In the case where the determining unit determines that a voice signal is included, the suppressor performs a process of subtracting a first suppression amount according to the third criterion value and subtracting a second suppression amount according to the fourth criterion value from the input signal. In the case where the determining unit determines that a voice signal is not included, the suppressor performs a process of subtracting only the first suppression amount according to the third criterion value from the input signal.

With the configuration, in a manner similar to [6], voice distortion noise can be easily suppressed.

[15] Suppression of Voice Distortion Noise in Voiced Sound

In the voice communication device of [13] or [14], the suppressor performs a process of suppressing a first signal amount according to the third criterion value and a second signal amount according to the fourth criterion value from an input signal containing a voice signal of voiced sound out of a plurality of input signals, each of which is determined by the determining unit (4001) to be an input signal containing a voice signal.

With the configuration, in a manner similar to [7], no adverse influence is exerted on the voice signal containing voiceless sound, by the process for suppressing noise.

[16] Noise According to Coding Method of Voice

In any of the voice communication devices of [9] to [15], voice distortion noise is noise based on the encoding.

With the configuration, the suppressing process can be performed in consideration of not only background noise, but also noise based on coding of a codec.

[17] Semiconductor Device in which Noise Caused by Distortion of Voice is Suppressed Another semiconductor device (3) according to a representative embodiment of the present invention includes: a decoder (11) which decodes an encoded input signal; a suppression processor (100, 400) which performs a suppressing process for suppressing noise included in the input signal decoded by the decoder; and one ore more storages (107, 208, 109) for storing one or more criterion values (SNR2, particular noise table) used in the suppressing process for suppressing voice distortion noise, and noise included in the decoded input signal.

With the configuration, the suppressing process can be performed in consideration of voice distortion noise. Thus, as compared with the case of considering only background noise, the precision of noise elimination can be increased.

[18] Noise According to Coding Method of Voice

In the semiconductor device of [17], voice distortion noise is noise based on the encoding.

With the configuration, in a manner similar to [8], the sound quality can be further improved.

[19] Suppression of Voice Distortion Noise in Voiced Sound

In the semiconductor device of [18], the suppression processor (400) performs a process for suppressing voice distortion noise, on an input signal containing a voice signal of voiced sound in input signals decoded by the decoder.

With the configuration, in a manner similar to [7], no adverse influence is exerted on a voice signal containing voiceless sound by the process for suppressing noise.

2. Details of Embodiments

Embodiments will be described more specifically.

First Embodiment

FIG. 1 illustrates, as an embodiment of a voice communication device, receiving and transmitting cellular phone terminals 1, 2, in which a voice processing device is installed for performing noise suppressing process for eliminating a noise component included in an input signal at the time of reproducing voice. In the diagram, a voice processing device 3 installed in a receiving cellular phone terminal 1 is, although not limited, formed on a semiconductor substrate made of single crystal silicon by a known CMOS integrated circuit manufacturing technique.

Referring to FIG. 1, the flow of processes in the case where voice communication data transmitted from a transmitting cellular phone terminal 2 is received and reproduced by the receiving cellular phone terminal 1 will be briefly described. In the diagram, only functional blocks necessary for explaining the processes are illustrated. Obviously, the receiving cellular phone terminal 1 has functional units for transmitting voice communication data (a transmitter, an encoder, and the like) and the transmitting cellular phone terminal 2 has function units for receiving voice communication data (a voice processor, a receiver, and the like).

First, voice uttered by a speaker is converted to an electric signal by a microphone provided in the transmitting cellular phone terminal 2. Since background noise from the surrounding environment in which the speaker exists is also supplied to the microphone, sound containing the voice and the background noise is converted to an electric signal. The electric signal generated by the microphone is encoded by an encoder. Although not limited, the method of encoding voice by the encoder is, for example, G.726 of AMR, ADPCM (Adaptive Differential Pulse Code Modulation), or the like. Encoded data generated by the encoding process of the encoder is transmitted by a predetermined transmitting method by a transmitter 21.

The receiving cellular phone terminal 1 receives encoded data transmitted from the transmitting cellular phone terminal 2 via a receiver 12. A decoder 11 performs a decoding process for decoding the received encoded data to generate PCM data. The voice processing device 10 performs various signal processes for reproducing voice on the basis of the PCM data and reproduces voice via a speaker.

Figure 2:
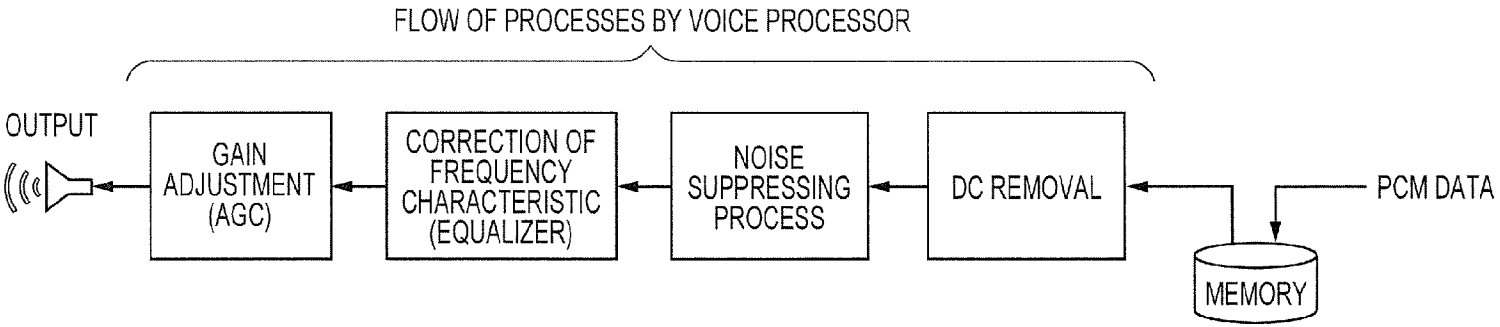
FIG. 2 is an explanatory diagram illustrating the signal processes performed by a voice processor 10.

FIG. 2 illustrates the flow of signal processes performed by a voice processor 10. As illustrated in FIG. 2, PCM data output from the decoder 11 is temporarily stored in a memory (buffer memory). The PCM data stored in the memory is sequentially read in predetermined data units, and subjected to various signal processes. For example, the signal process may be performed in data units of 80 samples in one frame. First, a DC component included in the PCM data is suppressed. After that, a noise suppressing process is performed to suppress a noise component included in the PCM data. To correct the sound quality, a process of correcting a frequency characteristic of a signal is performed. Finally, gain adjustment is performed so that the output level of a voice signal becomes a proper level.

Hereinafter, noise suppressing process by the voice processor 10 will be described in detail with reference to the drawings.

Figure 3:
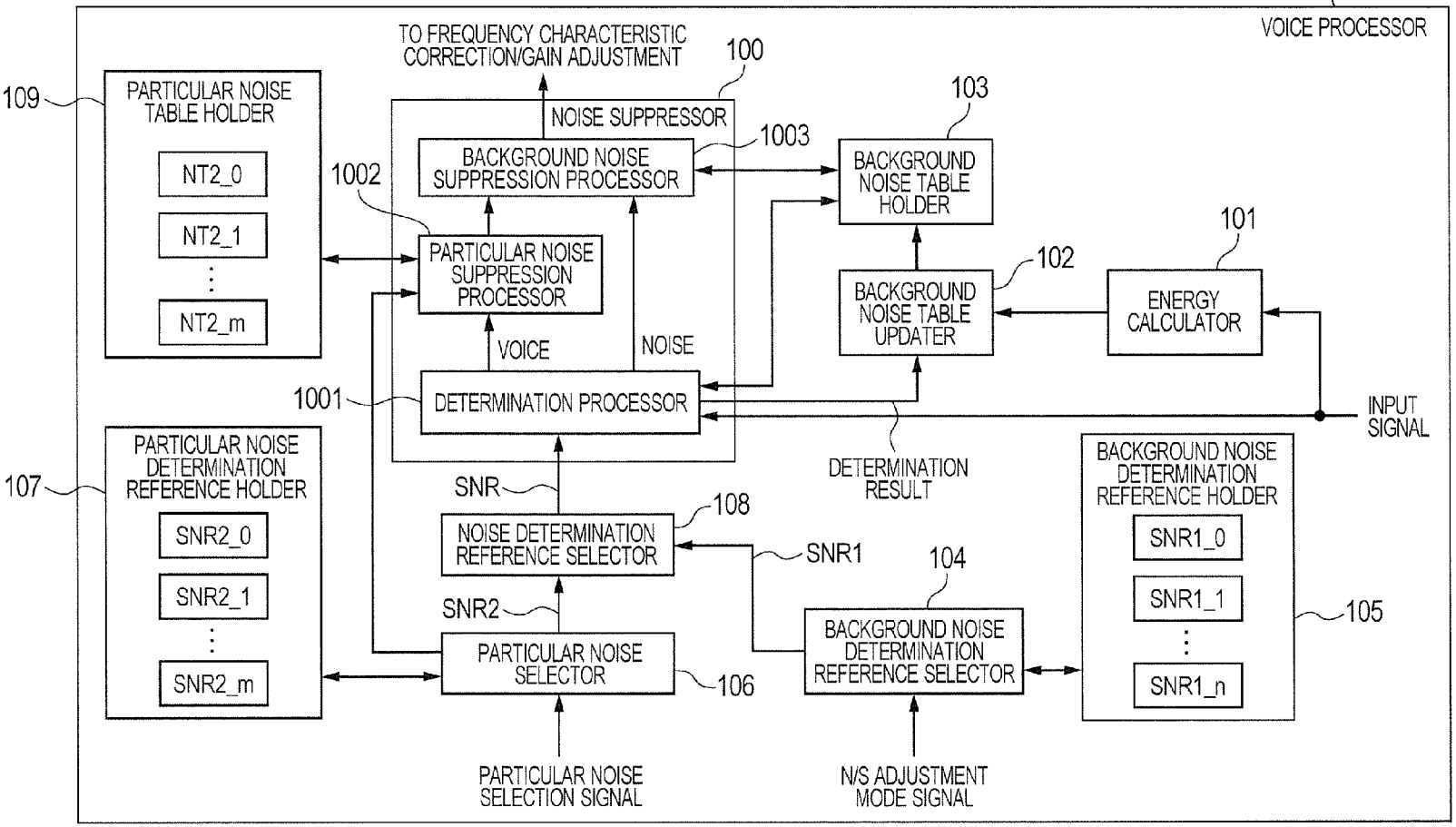
FIG. 3 is a block diagram illustrating the internal configuration of the voice processor 10.

FIG. 3 is a block diagram illustrating the internal configuration of the voice processor 10. In the diagram, for convenience of description, only functional blocks related to the noise suppressing process are illustrated. As illustrated in the diagram, the voice processor 10 has a noise suppressor 100, an energy calculator 101, a background noise table updater 102, a background noise table holder 103, a background noise determination reference selector 104, a background noise determination reference holder 105, a particular noise determination level holder 107, a particular noise selector 106, a particular noise table holder 109, and a noise determination reference selector 108. In the functional units, the noise suppressor 100, the energy calculator 101, the background noise table updater 102, the background noise determination reference selector 104, the particular noise selector 106, and the noise determination reference selector 108 may be implemented by a programmable processor, such as a CPU, executing one or more programs stored in a ROM (Read Only Memory) or a RAM (Random Access Memory). Although several of the functional blocks see in FIG. 3 are drawn outside the noise suppressor 100, some or even all of these functional blocks may be implemented by the determination processor 1001 drawn inside the noise suppressor 100.

The noise suppressing process by the voice processor 10 is performed by the noise suppressor 100 and is roughly divided into two processes. One of them is a determination process for determining whether or not a voice signal is included in PCM data of one frame which is received (hereinbelow, also simply called an input signal), and the other is a suppressing process for suppressing noise included in the input signal on the basis of the determination result.

First, the determination process will be described in detail. The determination process is performed by a determination processor 1001. As the determination processes performed by the determination processor 1001, there are two processes; a time-domain determination process performed on the time axis, and a frequency-domain determination process performed on the frequency axis. In the specification, the two determination processes are distinguished by describing the time-domain determination process performed on the time axis as "voiced sound/voiceless sound determining process", and describing the frequency-domain determination process performed on the frequency axis as a "noise determining process". Hereinafter, the noise determining process will be described in detail.

First, the determination processor 1001 performs fast Fourier transform (FFT) computation on the input signal and converts a time axis signal expressed by a time function to a signal on the frequency axis (spectrum signal). Next, the determination processor 1001 performs the noise determination process using a noise determination reference SNR on the converted input signal, thereby determining whether or not a voice signal is included in the input signal. The noise determination reference SNR is information for determining a threshold for discriminating noise and voice from each other and is, for example, a value expressed by "20 log (Ps/Pn)", where Ps denotes signal voltage (or signal current) of a voice signal, and Pn denotes signal voltage (or signal current) of noise. For each frame, the determination processor 1001 performs a process of comparing a first value obtained by multiplying the signal level of noise with the noise determination reference SNR, with a second value representing the signal noise of an input signal. If the second value which corresponds to the input signal is higher than the first value, the determination processor 1001 determines that the input signal corresponds to a voice frame; if second value which corresponds to the input signal is lower than the first value, the determination processor 1001 determines that the input signal corresponds to a noise frame. For example, when the value of the noise determination reference SNR is 22 dB (amplitude ratio: 13), the determination processor 1001 determines whether the signal level of an input signal with respect to the signal level of noise is 22 dB or higher. Specifically, when the signal level of the input signal is 13 times as high as that of noise, the determination processor 1001 determines that the input signal is a frame (voice frame) containing a voice signal. In the other case, the determination processor 1001 determines that the input signal is a frame which does not contain a voice signal (noise frame).

It is an issue to decide which noise determination reference to use, in the determining process by the determination processor 1001. For example, in the case of considering only background noise, in quiet environment where there is little noise, the S/N ratio of a voice signal with respect to background noise is high. Consequently, the determining process is performed with a noise determination reference having a high S/N ratio (large threshold). On the contrary, in noisy environment, the S/N ratio of a voice signal with respect to background noise is lower, so that the determining process is performed with a noise determination reference (small threshold) having a low S/N ratio. In such a manner, deterioration in determination precision caused by a change in call environment can be suppressed. However, as described above, an input signal includes voice distortion noise (hereinbelow, also called "particular noise") in addition to a linear noise component such as background noise. For example, the particular noise can include voice distortion noise caused by the encoding method of a codec, bit rate, compression ratio, and the like and voice distortion noise caused by an obstacle such as a mask or a helmet existing between a speaker and a microphone. Consequently, as described above, in the case where a voice signal is largely distorted by encoding of low bit rate by a codec or the like and the particular noise becomes larger than the assumed background noise, when the noise determining process is performed with the noise determination reference determined on the basis of the background noise, there is the possibility that an input signal is erroneously determined to be a noise frame in spite of the fact that the input signal is a voice frame, and the voice signal is wrongly suppressed by a subsequent suppressing process. To address the problem, the voice processor 10 in the embodiment performs the noise determining process in consideration of not only background noise but also particular noise. Concretely, the noise determining process is performed by using the lower noise determination reference between: (a) a background noise determination reference SNR1 indicative of the S/N ratio of a voice signal with respect to the background noise, and (b) a particular noise determination reference SNR2 indicative of the S/N ratio of a voice signal with respect to the particular noise.

First, the background noise determination reference SNR1 will be described in detail.

FIG. 4 illustrates the background noise determination references SNR1. As illustrated in the diagram, a plurality of background noise determination references SNR1 are prepared in accordance with call environments assumed, such as noise determination reference SNR1_0 (=45 dB) assuming a quiet call environment such as a quiet room, noise determination reference SNR1_1 (=22 dB) assuming a common call environment such as a normal room, and noise determination reference SNR1_*n* (=6 dB) assuming big noise. Information of the noise determination references SNR1_0 to SNR1_*n* (n denotes an integer of 1 or larger) is held in, for example, the background noise determination reference holder 105. The background noise determination reference holder 105 is implemented as a storage having a storage region for storing data, which is, for example, a memory. Information to be used as the background noise determination reference SNR1 in a given instance is determined by, for example, an N/S adjustment mode signal. The N/S adjustment mode signal is a signal indicating a specific background noise determination reference SNR1 within the background noise determination reference holder 105, and is received from the outside or via a user interface. Concretely, in response to one or more values in the N/S adjustment mode signal, the background noise determination reference selector 104 selectively reads one or more background noise determination references SNR1_0 to SNR1_*n* from the background noise determination reference holder 105 and supplies same as the background noise determination reference(s) SNR1 to the noise determination reference selector 108. For example, in the case where a single parameter value designated by the N/S adjustment mode signal is "1", the background noise determination reference selector 104 selects the background noise determination reference SNR1_1 (=22 dB) and supplies the information as the background noise determination reference SNR1 to the noise determination reference selector 108.

The particular noise determination reference SNR2 will now be described.

As described above, a voice signal is distorted by coding by a codec or the like. The inventors of the present invention found that the distortion of the voice signal can be modeled as a noise component which depends on the coding method of the codec, the bit rate, the compression ratio, and the like and which does not depend on the voice signal. For example, a particular noise component included in a voice signal coded by a predetermined coding method and at a predetermined bit rate can be modeled (digitized) as a noise component in any form such as a noise component in a white noise form which does not depend on frequency, a pulse-shaped noise component, or a noise component in a white noise form which is weighted at predetermined ratio by frequencies. In the embodiment, the particular noise determination reference SNR2 is calculated in advance on the basis of the modeled particular noise, and is stored in the storage in the voice processing device.

FIG. 5 illustrates various kinds of the particular noise determination references SNR2. As illustrated in the diagram, a plurality of particular noise determination references SNR2 are prepared in accordance with the particular noises assumed, such as a noise determination reference SNR2_2 in the case where the coding method by a codec is G.726 and the bit rate is 24 kbits/s and a noise determination reference SNR2_5 assuming a call when a mask is used. The noise determination references SNR2_0 to SNR2_*m* are calculated by the following method. For example, a particular noise component is modeled from the characteristic of a particular noise obtained on the basis of a result of simulation made in a designing stage or a result of evaluation of an actual device. An average energy of the modeled particular noise component is calculated and, on the basis of the average energy, a particular noise determination reference is calculated. The particular noise determination reference is, for example, calculated at a designing stage of a semiconductor device or a manufacturing stage of a cellular phone terminal and stored in the particular noise determination reference holder 107. The particular noise determination reference holder 107 is a storage device having a storage region for storing data, which is, for example, a memory. Information which is used as the noise determination reference SNR2 is determined by, for example, a particular noise selection signal. The particular noise selection signal is a signal indicating the particular noise to be considered and is received, for example, from the outside or via a user interface. Concretely, in response to one or more parameter values of the particular noise selection signal, the particular noise selector 106 reads the corresponding particular noise determination references SNR2_0 to SNR2_*m* from the particular noise determination reference holder 107 and supplies same as the particular noise determination reference(s) SNR2 to the noise determination reference selector 108. For example, in the case where the parameter values "0" and "5" are designated by the particular noise selection signal, the particular noise selector 106 selects the particular noise determination references SNR2_0 and SNR2_5 and supplies them to the noise determination reference selector 108.

The noise determination reference selector 108 receives the background noise determination reference SNR1 selected by the background noise determination reference selector 104 and the particular noise determination reference SNR2 selected by the particular noise selector 106, selects the lowest noise determination reference from the received noise determination references, and supplies it to the determination processor 1001 as a selected noise determination reference value (SNR). A method of determining the noise determination reference by the noise determination reference selector 108 is expressed as equation (1). In the equation (1), Ps denotes signal voltage (or signal current) of a voice signal, Pn_0 to Pn_m (m denotes an integer of 1 or larger) denotes signal voltage (or signal current) of particular noise, and Pb denotes signal voltage (or signal current) of the background noise. By the determination method of equation (1), for example, in the case where the background noise determination reference SNR1_1, the particular noise determination reference SNR2_0, and the particular noise determination reference SNR2_5 are supplied to the noise determination reference selector 108, when the value of the particular noise determination reference SNR2_0 is the smallest, the particular noise determination reference SNR2_0 is selected and supplied to the determination processor 1001 as the selected noise determination reference value. The determination processor 1001 uses the selected noise determination reference value from the noise determination reference selector 108 and performs noise determining process by the above-described method.

$$SNR = \mathrm{Min}\left(20\log_{10}\frac{\sum Ps}{\sum \mathrm{Pn_0}}, \ldots, 20\log_{10}\frac{\sum Ps}{\sum \mathrm{Pn_m}}, 20\log_{10}\frac{\sum Ps}{\sum Pb}\right). \quad \text{Equation (1)}$$

Consequently, even in the case where a voice signal is largely distorted by encoding of low bit rate and particular noise according to the distortion becomes larger than the assumed background noise, the noise determining process is performed using the lowest noise determination reference. Therefore, the probability that a frame containing a voice signal is erroneously determined to be a noise frame becomes low.

Next, the suppressing process will be described in detail. The suppressing process varies depending on whether or not the input signal is a voice frame. Concretely, on an input signal determined to be a voice frame by the noise determining process, the particular noise suppressing process of suppressing particular noise, and the background noise suppressing process of suppressing background noise are both performed. On the other hand, on an input signal determined to be a noise frame, only the background noise suppressing process is performed.

The particular noise suppressing process will be described. The spectrum signal of an input signal determined to be a voice frame by the determination processor 1001 is supplied to a particular noise suppression processor 1002. The spectrum signal has, for example, a data structure including spectrum data in each of 81 frequency bands. The particular noise suppression processor 1002 performs the particular noise suppressing process on the spectrum signal on the basis of the value of a particular noise table.

FIG. 6 is an explanatory diagram illustrating a particular noise table. As illustrated in the diagram, the particular noise table has, for example, a data structure in which spectrum data expressing loudness of particular noise is stored for each of the 81 frequency bands. The number is not limited to 81 but may correspond to the number of frequency points in FFT computation in the noise suppressing process. The spectrum data in each frequency band is, for example, data obtained by modeling (digitizing) particular noise in each frequency band from the characteristic of particular noise obtained on the basis of a result of simulation made in the designing stage or a result of evaluation of a real device. In the embodiment, a particular noise table is generated in advance for each kind of particular noise assumed, and stored in the storage device of the voice processing device.

FIG. 7 illustrates kinds of particular noise tables, one table for each kind of voice distortion noise. As illustrated in the diagram, a plurality of particular noise tables NT2 are prepared according to assumed particular noises, such as a particular noise table NT2_1 in the case where the coding method by a codec is G.726 and the bit rate is 24 kbits/s and a particular noise table NT2_5 assuming a call when a mask is used. The information of the particular noise tables NT2_0 to NT2_*m* is stored, for example, in the particular noise table holder 109. The particular noise table holder 109 is a storage device having a storage region for storing data, which is, for example, a memory. A particular noise table used for the particular noise suppressing process is determined by, for example, a particular noise selection signal. In response to the particular noise selection signal, the particular noise suppression processor 1002 reads one of the particular noise tables NT2_0 to NT2_*m* from the particular noise table holder 109, performs a particular noise suppressing process by using the thus-read table, and eliminates a particular noise component from the input signal. Concretely, the particular noise suppression processor 1002 performs a process of subtracting the value of spectrum data in the particular noise table designated by the particular noise selection signal from the value of the spectrum data of the input signal. The subtracting process is performed in each of the 81 frequency bands.

The background noise suppressing process will be described. An input signal (spectrum signal) determined to be a noise frame (i.e., not containing voice data) by the determination processor 1001 is supplied directly to the background noise suppression processor 1003, and not via the particular noise suppression processor 1002. The input signal (spectrum signal) of a voice frame in which the particular noise component is suppressed by the particular noise suppression processor 1002 is also supplied to the background noise suppression processor 1003. The background noise suppression processor 1003 performs background noise suppressing process on the input spectrum signal. Concretely, the background noise suppression processor 1003 performs a process of reading the value of a background noise table stored in the background noise table holder 103 and subtracting a value obtained by multiplying the thus-read value of the table with a predetermined factor from the input spectrum signal. The subtracting process is performed in each of the frequency bands. The background noise table has, for example, a data structure in which spectrum data expressing loudness of background noise is stored in each of 81 frequency bands, much like in the particular noise table illustrated in FIG. 6. The background noise table holder 103 is a storage having a storage region for storing data, which is, for example, a memory. The predetermined factor is a factor for increasing/decreasing a subtraction amount of the background noise and is set to a value which varies depending on, for example, whether or not the input signal is a voice frame. For example, for an input signal determined to be a noise frame, by setting the predetermined factor to a large value, the amount of suppression is increased. On the other hand, for an input signal determined to be a voice frame, by setting the predetermined factor to a small value, the amount of suppression is decreased. The background noise suppression processor 1003 performs inverse fast Fourier transform (IFFT) on a spectrum signal subjected to the background noise suppressing process to inversely transform the signal back to a time axis signal expressed as a function of time. The inversely transformed input signal is supplied to the function unit performing frequency characteristic adjustment, gain adjustment, and the like and, finally, reproduced by a speaker.

A method of generating a background noise table will be described. The background noise table updater 102 expects that, for a predetermined period immediately after start of a call, an input signal does not include a voice signal but includes only background noise and generates a background noise table by using the predetermined period after start of the system. Concretely, first, the energy calculator 101 calculates average energy of an input signal (PCM data in one frame) supplied in the predetermined period immediately after start of a call. Next, the background noise table updater 102 performs the FFT computing process on the calculated average energy to generate spectrum data for each of the 81 frequency bands. The background noise table updater 102 stores the generated spectrum data into the background noise table holder 103. After that, in the case where the input signal is determined to be a noise frame in the noise determining process performed by the determination processor 1001 and the noise period continues longer than the predetermined period, the background noise table updater 102 generates spectrum data for each frequency band on the basis of the average energy of the input signal, and updates the background noise table stored in the background noise table holder 103. At the time of updating the background noise table, occurrence of a sharp change in the background noise table is prevented. In such a manner, the background noise table can be updated in accordance with a change in a call environment. The flow of the noise suppressing process by the voice processor 10 will be described in detail.

Figure 8:
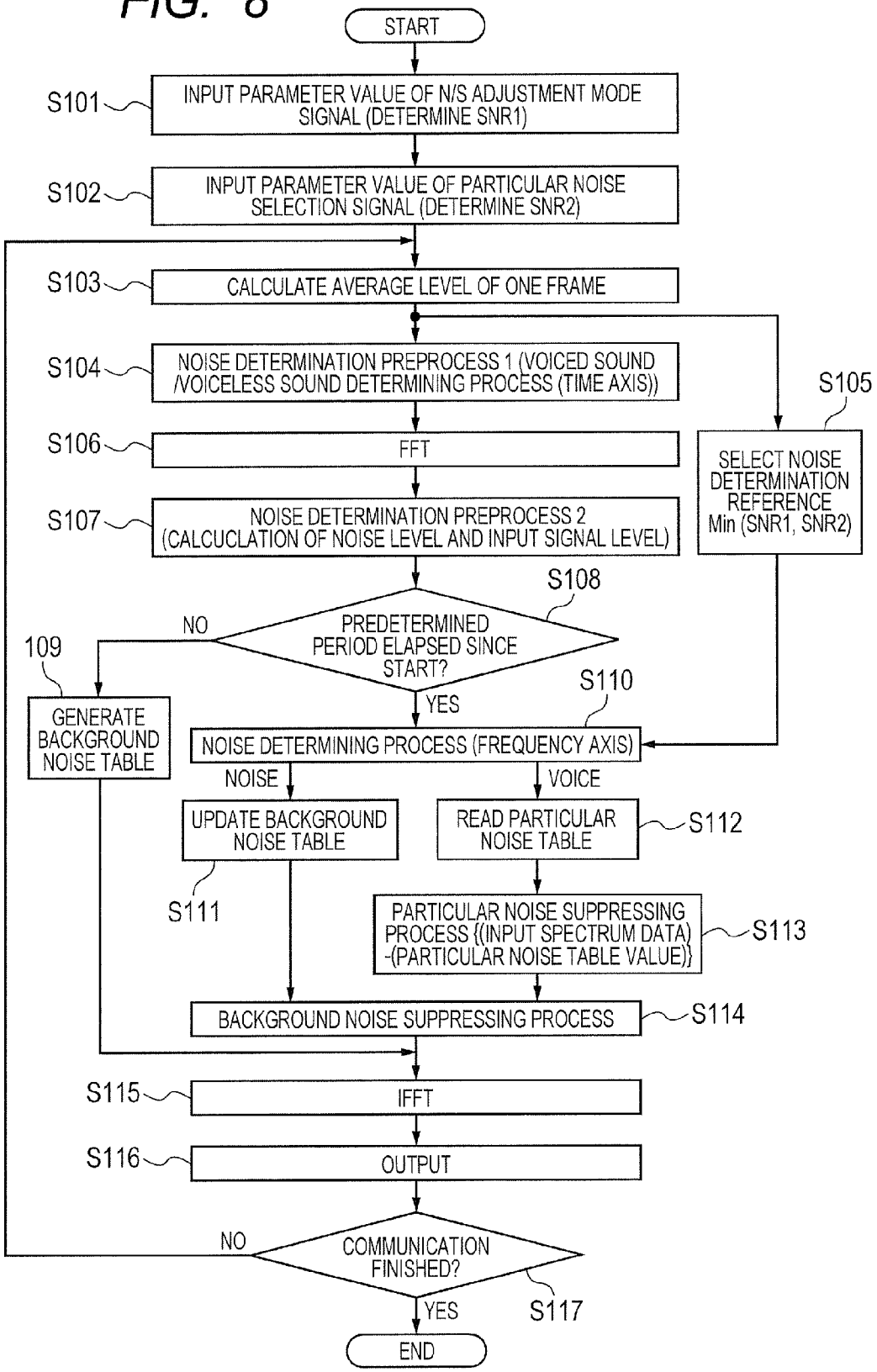
FIG. 8 is a flowchart illustrating the noise suppressing process performed by the voice processor 10.

FIG. 8 is a flowchart illustrating the flow of noise suppressing process performed by the voice processor 10.

When a call is started between the cellular phone terminals 1 and 2 and PCM data is stored in a buffer memory, the noise suppressing process is started. First, the background noise determination reference SNR1 is determined (S101). Concretely, when an N/S adjustment mode signal is received, the background noise determination reference selector 104 reads one or more of the background noise determination references SNR1_0 to SNR1_*n* based on the parameter value(s) designated by the N/S adjustment mode signal from the background noise determination reference holder 105, and supplies same to the noise determination reference selector 108. Next, the particular noise determination reference SNR2 is determined (S102). Concretely, when a particular noise selection signal is received, the particular noise selector 106 reads one or more of the particular noise determination references SNR2_0 to SNR2_*m* based on the parameter value(s) designated by the peculiar noise selection signal from the particular noise determination reference holder 107, and supplies same to the noise determination reference selector 108.

When PCM data (input signal) of one frame in which a DC component is suppressed is supplied to the determination processor 1001, the determination processor 1001 calculates the average energy of the input signal (S103). The determination processor 1001 determines whether or not a voice signal is included in the input signal on the basis of the calculated average energy (S104). The determining process is a voiced sound/voiceless sound determining process performed on the time axis. In the voiced sound/voiceless sound determining process, although not limited, the presence or absence of a voice signal is determined on the basis of the correlation between the average energy of the frame and the average energy of a frame immediately preceding to the frame.

The determination processor 1001 obtains the noise determination reference SNR used for the noise determining process performed on the frequency axis (S105). Specifically, the noise determination reference selector 108 selects the smallest noise determination reference from the input background noise determination reference SNR1 and the particular noise determination reference SNR2, and supplies same to the determination processor 1001 as the selected noise determination reference value SNR.

The determination processor 1001 performs the FFT computation process on the input signal subjected to the noise determining process on the time axis in step S103 to generate a spectrum signal (S106). The spectrum signal includes, for example, spectrum data for each of the 81 frequency bands. The determination processor 1001 calculates the signal level of an input signal (input signal level) and signal level of noise (noise level) (S107). Concretely, the determination processor 1001 generates single data expressing an input signal level from the spectrum data for each of the 81 frequency bands related to the input signal. In the case where the background noise table is generated, the determination processor 1001 generates single data expressing a noise level from the spectrum data for each of the 81 frequency bands in the background noise table. The subsequent process is branched depending on whether or not the predetermined period has elapsed since start of the call (S108). At step 108, if it is the case where a predetermined period has not elapsed since start of the call, the background noise table updater 102 generates a background noise table by the above-described method and stores it in the background noise table holder 103 (S109). The determination processor 1001 performs the IFFT computation on the input signal converted to the spectrum signal in the step S106 to inversely transform the signal back to a signal on the time axis (S115). The inversely transformed input signal is output to the function part which corrects a frequency characteristic in a post stage (S116). After that, whether or not the call has been finished is determined (S117). In the case where the call has been finished, the noise suppressing process in the voice processor 10 is finished. When the call has not been finished, the program returns to step S103. That is, the input signal which is received until the predetermined period elapses since start of a call is used for generation of a background noise table, but the input signal is not subjected to the noise suppressing process and is reproduced as it is.

On the other hand, at step S108, if the predetermined period since start of the call has lapsed, the input signal is supplied to the determination processor 1001 and the noise determining process is performed (S110).

Figure 9:
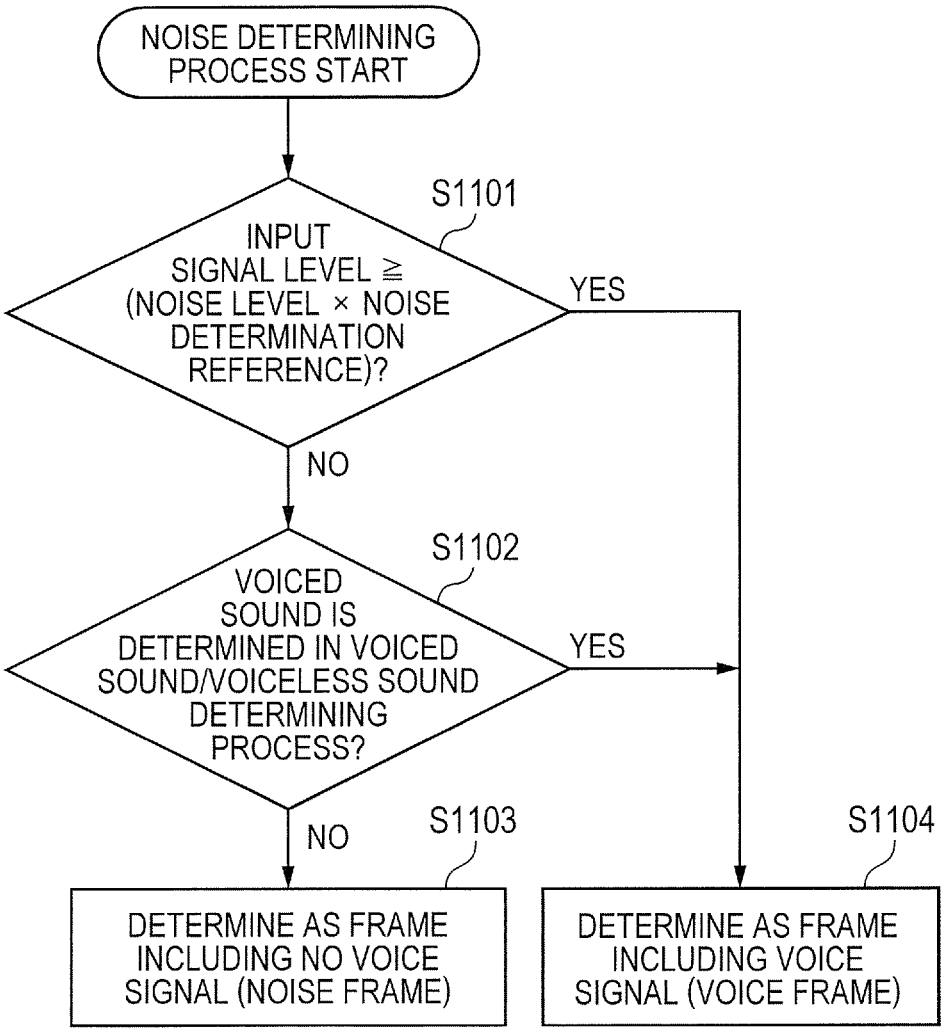
FIG. 9 is a flowchart illustrating the noise determining process.

FIG. 9 is a flowchart illustrating the flow of noise determining process. First, the determination processor 1001 compares a first value obtained by multiplying the signal level of noise with the noise determination reference SNR, with a second value representing the signal level of an input signal. Concretely, a first value obtained by multiplying the level of noise calculated in the step S107 with the noise determination reference SNR determined in the step S105 is compared with the second value representing input signal level calculated in the step S107. In the case where the input signal level is higher in step S1101, the determination processor 1001 determines that the input signal is a voice frame (S1104). On the other hand, in the case where the input signal level is lower, the determination processor 1001 refers to the determination result in the step S104 (S1102). If, in the step S104, the frame was determined to be a voice frame, the determination processor 1001 determines that the input signal is a voice frame (S1104). On the other hand, if in the step S104, the frame was determined to be a noise frame, the determination processor 1001 determines that the input signal is a noise frame (S1103).

If in step S110, the input signal is determined to be a noise frame, the determination result is notified to the background noise table updater 102, and the background noise table updater 102 updates the background noise table by the above-described method (S111). In the input signal determined as a noise frame, a background noise component is suppressed by the background noise suppression processor 1003 (S114).

If, in step 110, the input signal is determined to be a voice frame, the particular noise suppression processor 1002 reads the value in the particular noise table corresponding to the parameter value designated by the particular noise selection signal (S112). The particular noise suppression processor 1002 performs the particular noise suppressing process on the basis of the thus-read particular noise table (S113). After that, in the spectrum signal in which the particular noise component is suppressed, the background noise component is also suppressed by the background noise suppression processor 1003 (S114). The background noise suppression processor 1003 performs the IFFT on either the spectrum signal in which the particular noise component and the background noise component have been suppressed, or the spectrum signal in which only the background noise component has been suppressed, and inversely transforms the spectrum signal to a signal on the time axis (S115). The inversely transformed input signal is output to the function unit for correcting the frequency characteristic at the post stage (S116). Whether or not the call is finished is determined (S117). If the call is finished, the noise suppressing process in the voice processor 10 is finished. If the call is not finished, the program returns again to the step S103 and the processes in steps S103 to S116 are repetitively performed until the call is finished.

According to the first embodiment, in the case where noise other than the background noise exists, a noise determination criterion value can be determined according to the determining method of the equation (1). Consequently, as compared with the method of performing the noise determination using the noise determination criterion value based only on the background noise, the probability of erroneously determining that a frame containing a voice signal is a noise frame can be lowered, and precision of the noise determining process can be increased. Further, by performing the particular noise suppressing process, not only the background noise but also the voice distortion noise are suppressed. Thus, noise elimination can be performed at higher precision.

Second Embodiment

Figure 10:
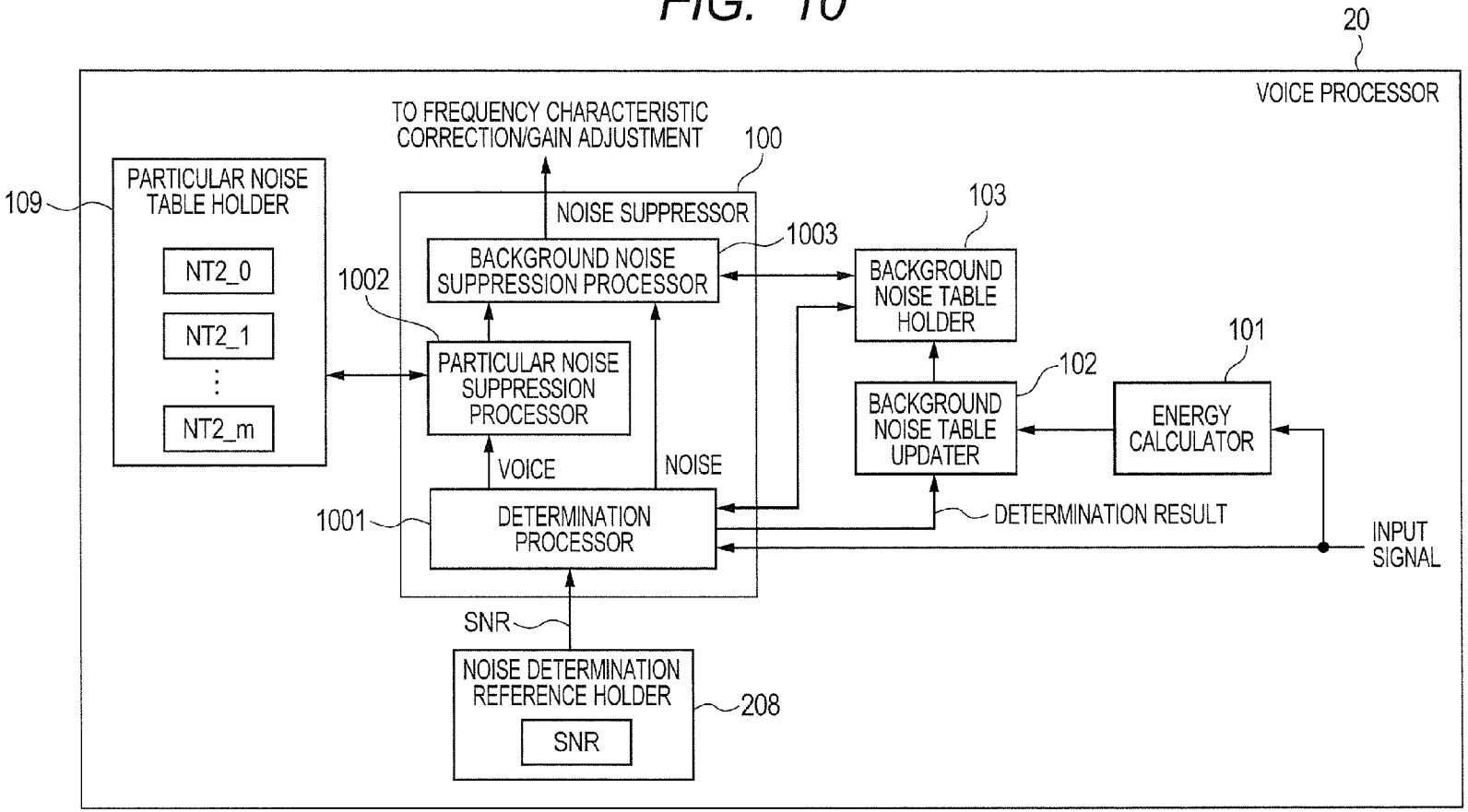
FIG. 10 is a block diagram illustrating the internal configuration of a voice processor according to a second embodiment.

FIG. 10 illustrates an example of the internal configuration of the voice processor according to a second embodiment. Unlike the voice processor 10 of the first embodiment, the voice processor 20 illustrated in FIG. 10 does not have the function of selecting the noise determination reference SNR. Concretely, the voice processor 20 has a noise determination reference holder 208 in place of the following items in the first embodiment: the noise determination reference selector 108, the particular noise determination reference holder 107, the particular noise selector 106, the background noise determination reference selector 104, and the background noise determination reference holder 105. Also, in the voice processor 20, there is no particular noise selection signal or N/S adjustment signal, both of which are seen in voice processor 10.

The noise determination reference holder 208 is a storage device having a storage region for storing data, which is, for example, a memory. In the noise determination reference holder 208, information of the noise determination reference SNR determined on the basis of the equation (1) is stored. For example, at the stage of designing a semiconductor integrated circuit including the voice processor 10, the background noise determination reference SNR1 according to an assumed call environment and the particular noise determination reference SNR2 according to assumed particular noise are calculated, and information of the smallest noise determination reference is written in the noise determination reference holder 208. The information may be written in the noise determination reference holder 208 from the outside at the stage of designing a cellular phone terminal. Similarly, a particular noise table according to assumed particular noise is written also in the particular noise table holder 109. For example, in the case where the encoding method of a codec is AMR, the particular noise table NT2_0 is stored. In the case where the coding method is G.726 and the bit rate is 24 kbits/s, the particular noise table NT2_2 is stored.

Figure 11:
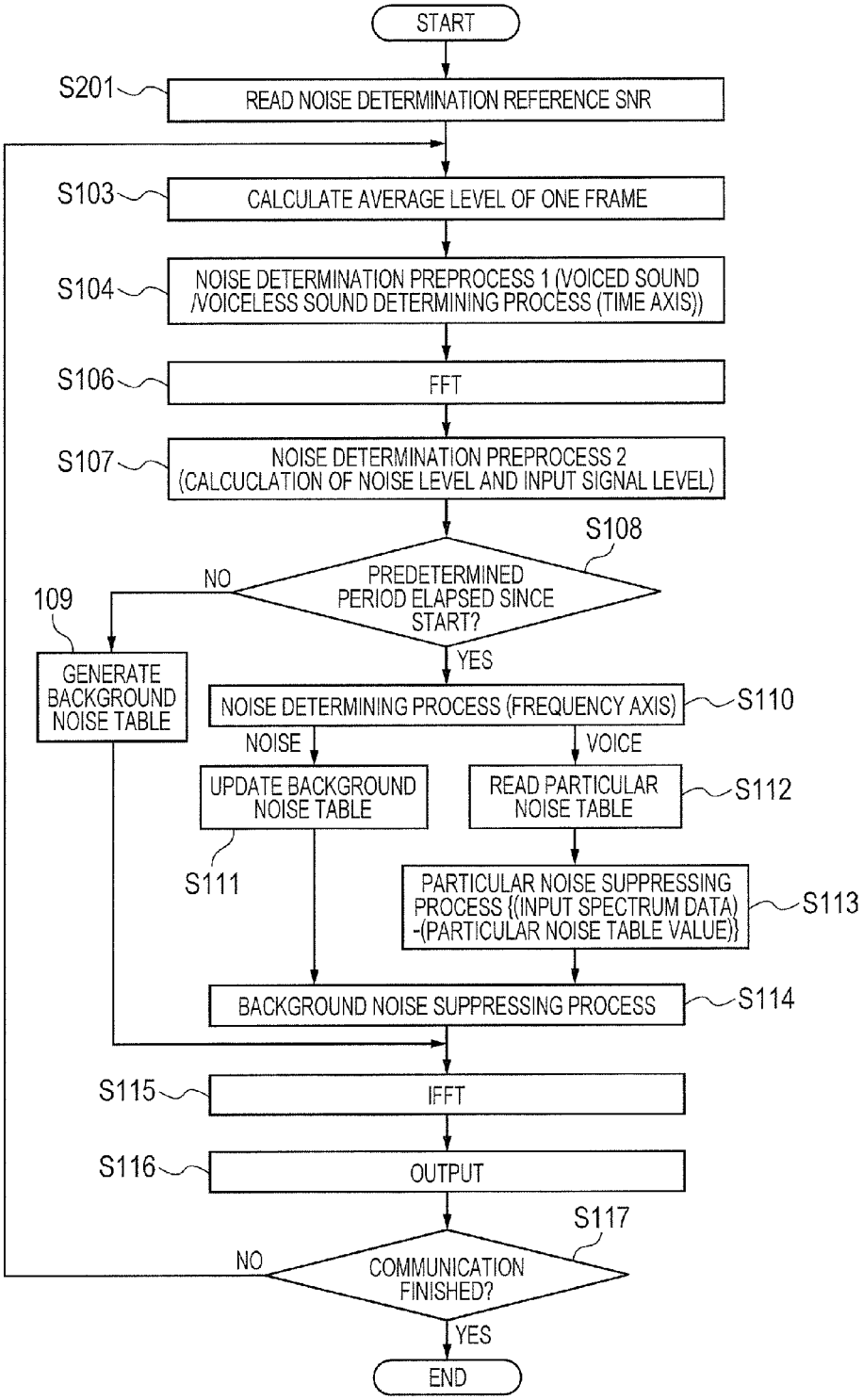
FIG. 11 is a flowchart illustrating the noise determining process performed by a voice processor 20.

FIG. 11 illustrates the flow of the noise determining process performed by the voice processor 20.

When a call is started between the cellular phone terminals 1 and 2, the noise suppressing process is started. First, the noise determination reference SNR is obtained (S201). Concretely, the determination processor 1001 reads the noise determination reference SNR stored in the noise determination reference holder 208, thereby determining the noise determination reference SNR used in the noise determining process. The subsequent processes are almost similar to those in the process flow illustrated in FIG. 8 except that step S105 (the process of selecting the noise determination reference on the basis of SNR1 and SNR2) is omitted in the flow of the noise determining process for the second embodiment.

According to the second embodiment, the noise determining process can be performed in consideration of not only background noise, but also particular noise. Therefore, in a manner similar to the first embodiment, the precision of the noise determining process can be increased. By performing the particular noise suppressing process, not only the background noise but also voice distortion noise are suppressed, so that higher-precision noise elimination can be performed. Further, in the second embodiment, since the noise determination reference determined on the basis of the equation (1) is preliminarily stored in the noise determination reference holder 208, the function unit for selecting one noise determination reference from a plurality of noise determination references becomes unnecessary. Thus, the system configuration can be simplified.

Third Embodiment

Figure 12:
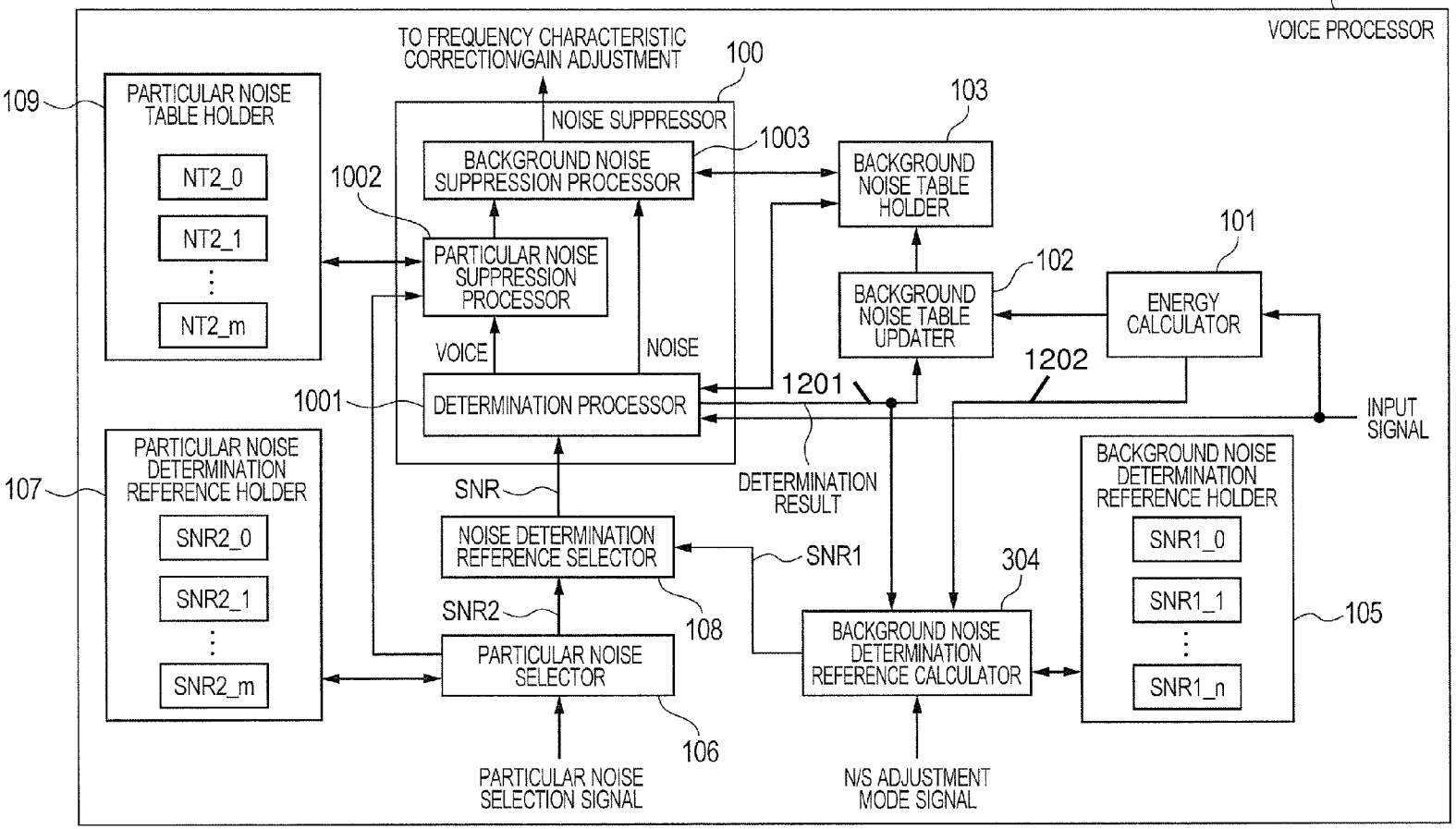
FIG. 12 is a block diagram illustrating the internal configuration of a voice processor according to a third embodiment.

FIG. 12 illustrates the internal configuration of a voice processor according to a third embodiment. A voice processor 30 illustrated in the diagram has the function of the voice processor 10 according to the first embodiment and, in addition, a function of updating the background noise determination reference SNR1 in accordance with a change in background noise. Concretely, the voice processor 30 has a background noise determination reference calculator 304 in place of the background noise determination reference selector 104.

The background noise determination reference calculator 304 calculates the background noise determination reference SNR1 on the basis of an input signal determined as a noise frame and supplies it to the noise determination reference selector 108. For example, the background noise determination reference calculator 304 monitors a determination result 1201 by the determination processor 1001, when a noise frame is determined, calculates the noise determination reference SNR1 on the basis of average energy 1202 of the input signal calculated by the energy calculator 101, and supplies it to the noise determination reference selector 108. The noise determination reference SNR1 may be updated by monitoring a determination result as described above or may be updated at a timing of updating the background noise table. The update frequency is not limited.

Figure 13:
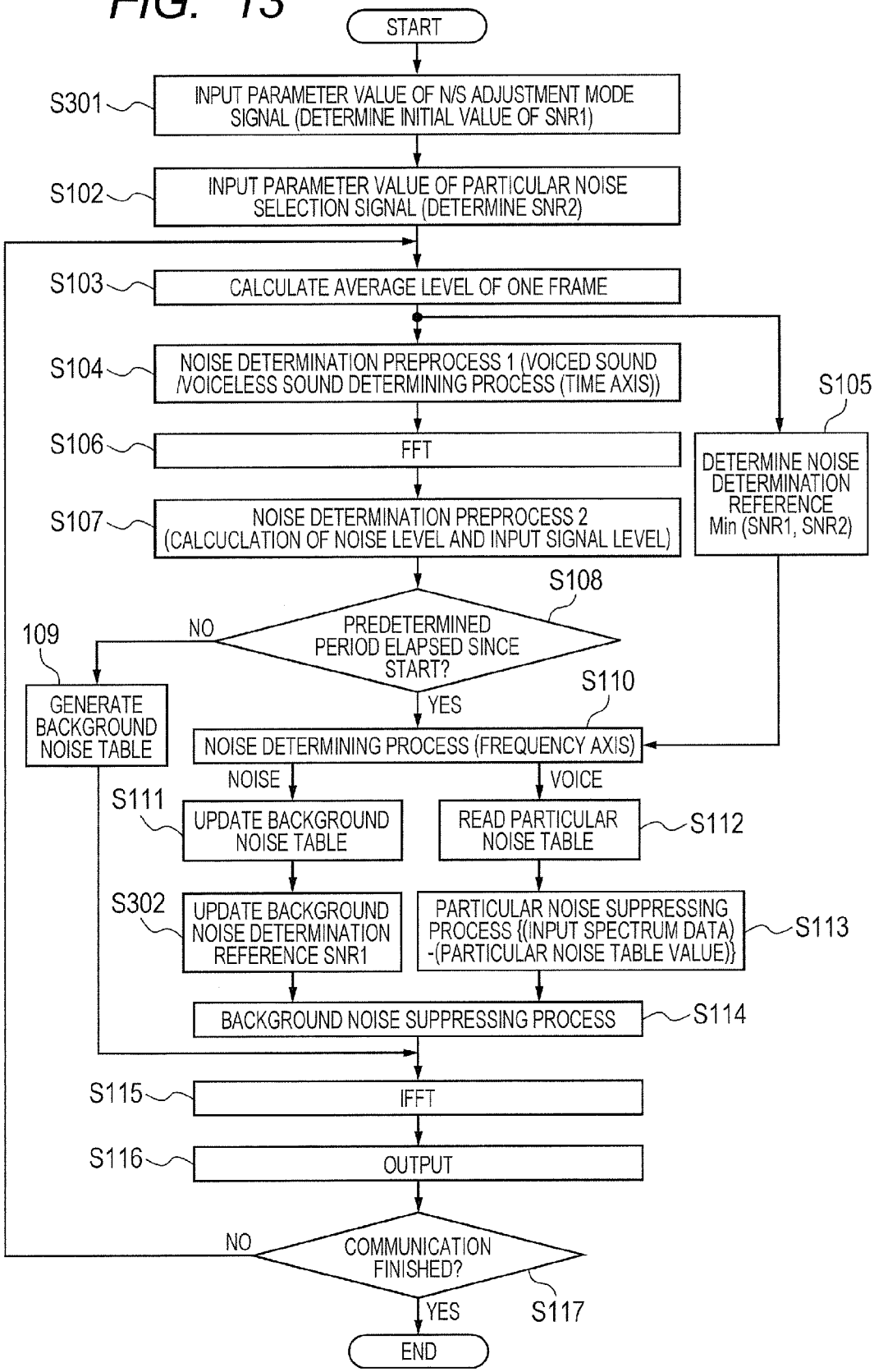
FIG. 13 is a flowchart illustrating the noise suppressing process performed by a voice processor 30.

FIG. 13 illustrates the flow of noise suppressing process performed by the voice processor 30.

When a call is started between the cellular phone terminals 1 and 2, the noise suppressing process is started. First, an initial value of the background noise determination reference SNR1 is determined (S301). Concretely, when the N/S adjustment mode signal is received, the background noise determination reference calculator 304 reads one or more of the background noise determination references SNR1_0 to SNR1_*n* based on the parameter value(s) designated by the N/S adjustment mode signal from the background noise determination reference holder 105 and supplies same to the noise determination reference selector 108. The following steps until the step S110 are similar to those in the process flow of FIG. 8.

When the input signal is determined to be a voice frame in step S110, in a manner similar to the above, the process of suppressing the particular noise component and the background noise component is performed (S112 to S114). On the other hand, when the input signal is determined to be a noise frame in step S110, the background noise table is updated (S111). The background noise determination reference calculator 304 calculates a background noise determination reference on the basis of average energy 1202 of the input signal determined to be a noise frame by the above-described method and supplies it as a new background noise determination reference SNR1 to the noise determination reference selector 108. The following processes are similar to those in FIG. 8.

According to the third embodiment, in a manner similar to the first embodiment, the precision of the noise determination can be increased, and higher precision noise elimination can be realized. According to the third embodiment, for example, even when the speaker moves from a noisy call environment to a quiet call environment and the S/N ratio for particular noise caused by encoding becomes lower than the S/N ratio for background noise, an optimum noise determination reference can be selected according to the change, and precision of noise determination can be further increased.

Fourth Embodiment

Figure 14:
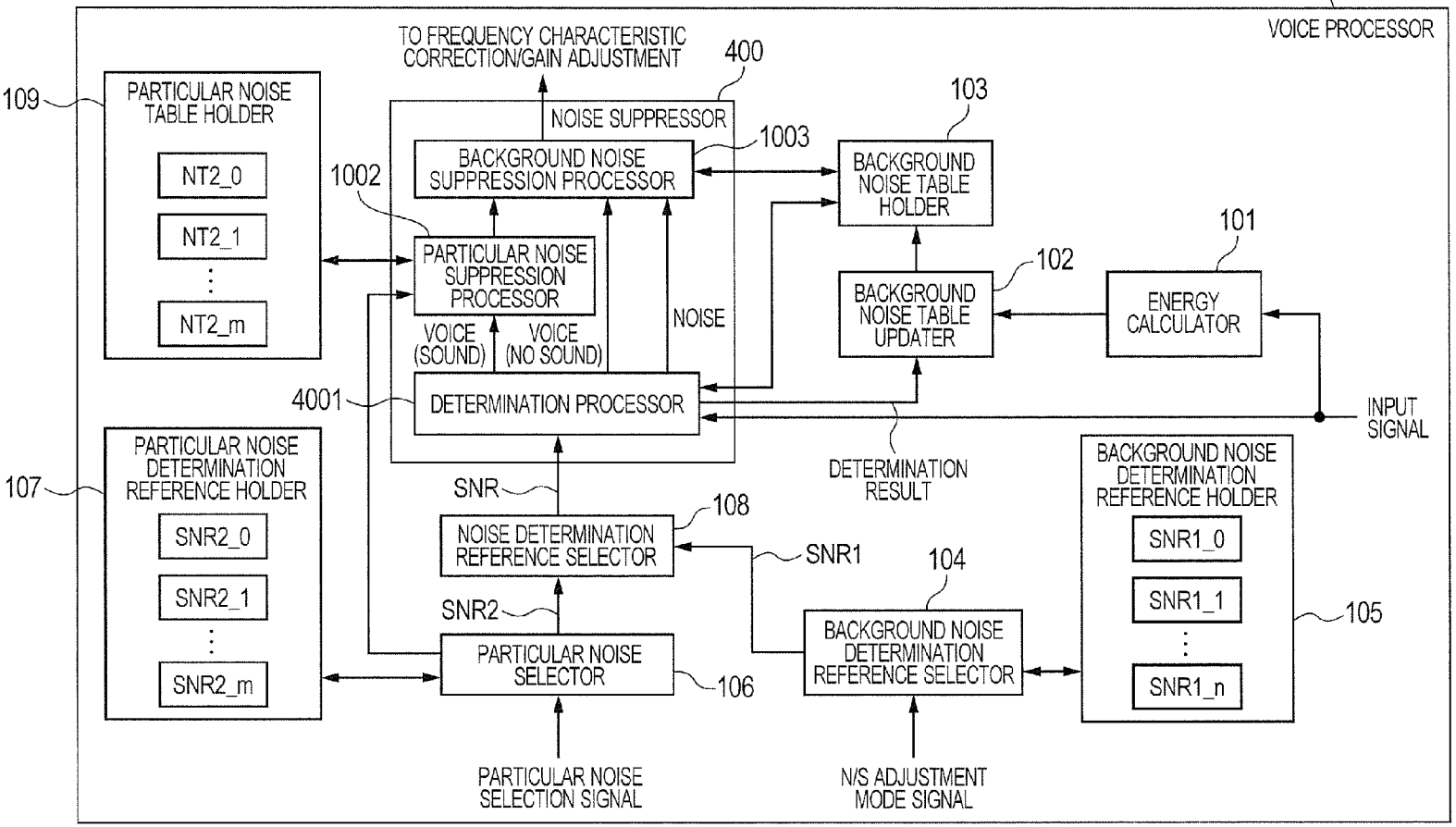
FIG. 14 is a block diagram illustrating the internal configuration of a voice processor according to a fourth embodiment.

FIG. 14 illustrates the internal configuration of a voice processor according to a fourth embodiment. A voice processor 40 illustrated in the diagram has a function of discriminating voiced sound and voiceless sound and performing the suppressing process in addition to the function of the voice processor 10 according to the first embodiment.

The voiced sound is sound accompanying periodic vibration of the vocal cords and has a characteristic that similar waveforms repeat. On the other hand, the voiceless sound is sound which passes through without vibrating the vocal cords and is close to noise waveform of white noise or the like, and repetitive waveforms are not detected. The spectrum power of voiceless sound is much smaller than that of voiced sound. Consequently, when a process of subtracting a spectrum component of modeled particular noise from spectrum data of an input signal containing voiceless sound is performed, there is the possibility that spectrum distortion occurs. The voice processor 40 according to the fourth embodiment performs a process of suppressing particular noise on a voice frame containing voiced sound and does not perform the process of suppressing particular noise on a voice frame containing voiceless sound. In other words, in the fourth embodiment, voiced sound and voiceless sound are treated differently.

A determination processor 4001 in a noise suppressor 400 illustrated in FIG. 14 discriminates a noise frame and a voice frame by the noise determining process like the above-described determination processor 1001. After the discrimination, the determination processor 4001 performs a voiced sound/voiceless sound determining process for discriminating whether or not voiced sound is included on a voice frame. The determination processor 4001 determines the presence/absence of voiced sound from the appearance ratio of the waveform periodicity using the fact that the waveform (characteristic) of voiced sound has periodicity. Concretely, the determination processor 4001 determines the presence/absence of voiced sound on the basis of the strength of correlation pitch. For example, when a normalized cross-correlation pitch value is equal to or larger than a predetermined threshold, voiced sound is determined. When a normalized cross-correlation pitch value is less than the threshold, voiceless sound is determined. The voiced sound/voiceless sound determining method by the determination processor 4001 is not limited to the above-described method, but other methods may be used. For example, to determine even voiced sound in which periodicity is unclear at high precision, a determination may be performed using the number of zero crossing times or the like in addition to the normalized cross-correlation pitch value.

An input signal (spectrum signal) of a voice frame determined to contain voiced sound by the voiced sound/voiceless sound determining process is supplied to the particular noise suppression processor 1002, and particular noise is suppressed by the above-described method. On the other hand, an input signal (spectrum signal) of a voice frame determined not to contain voiced sound (voiceless sound) is supplied to the background noise suppression processor 1003, and background noise is suppressed by the above-described method. In such a manner, without deteriorating the characteristic of the voiceless sound, noise can be effectively suppressed, and it contributes to improvement in the call quality.

Although not limited, the background noise suppressing process by the background noise suppression processor 1003 varies between a voice frame and a noise frame in a manner similar to the first embodiment. However, the process does not vary between a voice frame of voiced sound and a voice frame of voiceless sound.

Figure 15:
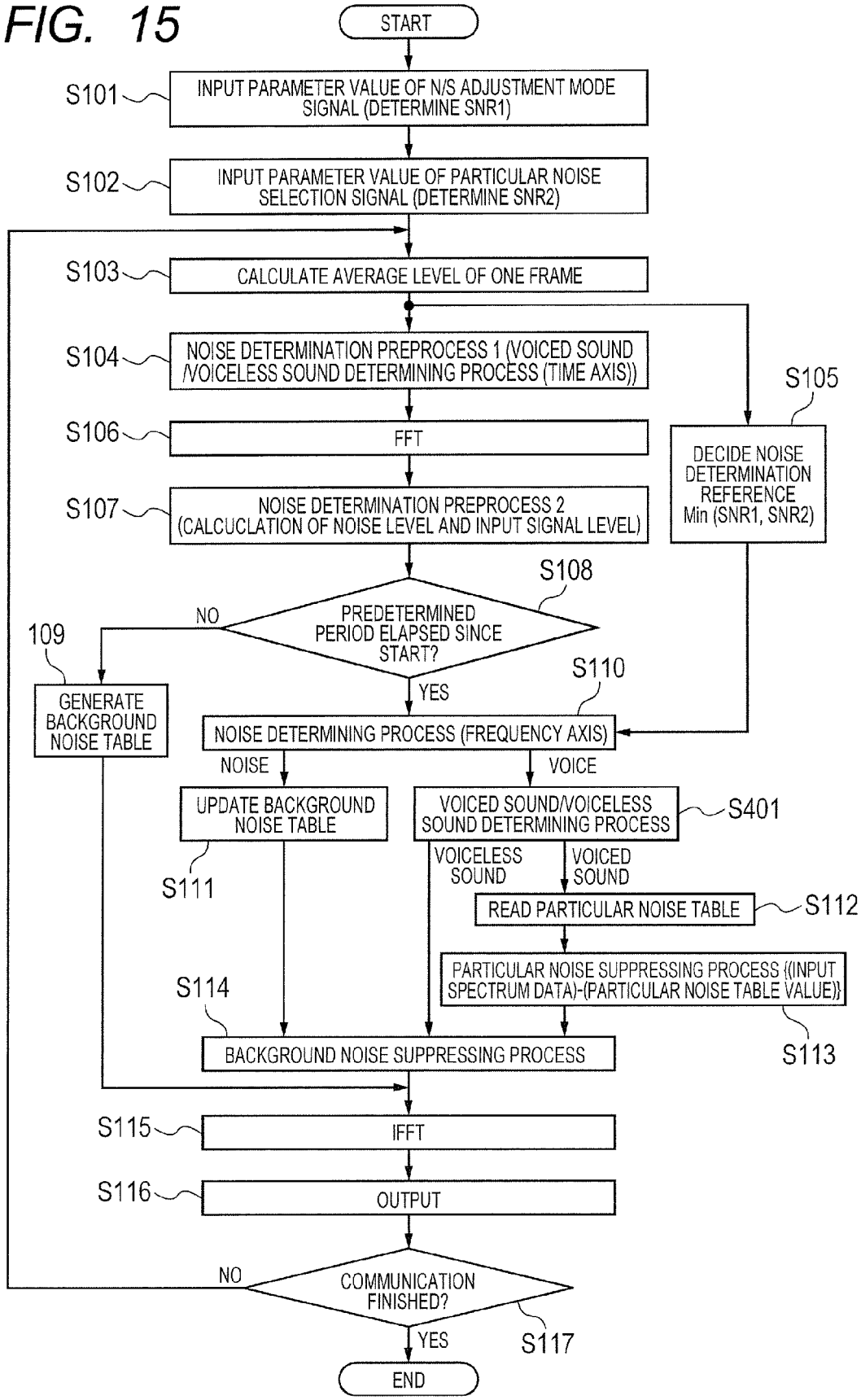
FIG. 15 is a flowchart illustrating the noise suppressing process performed by a voice processor 40.

FIG. 15 illustrates the flow of noise suppressing process performed by the voice processor 40.

Steps S101 to S110 are similar to those in the process flow of FIG. 8.

In the case where an input signal is determined as a noise frame in step S110, like in FIG. 8, processes of updating a background noise table and suppressing a background noise component in a noise frame are performed (S111 and S114). On the other hand, when an input signal is determined as a voice frame in step S110, the determination processor 4001 further performs the voiced sound/voiceless sound determining process on the input signal determined as a voice frame (S401). In the case where the voiced sound is determined in step S401, like in FIG. 8, processes of suppressing particular noise and background noise from the input signal are performed (S112 and S114). On the other hand, in the case where voiceless sound is determined in step S401, a process of suppressing background noise from the input signal is performed (S114). The following processes are similar to those in FIG. 8.

According to the fourth embodiment, like the first embodiment, precision of noise determination can be increased. By discriminating a voice frame of voiced sound and a voice frame of voiceless sound and performing the noise suppressing process, without deteriorating the characteristic of the voiceless sound, noise can be effectively suppressed, and it contributes to improvement in the call sound quality.

Although the present invention achieved by the inventors herein has been concretely described on the basis of the embodiments, obviously, the invention is not limited to the embodiments but can be variously changed without departing from the gist of the invention.

For example, in the fourth embodiment, the function of discriminating voiced sound and voiceless sound and performing the noise suppressing process is added to the voice processor 10 in the first embodiment. The invention, however, is not limited to the configuration. This function can be added to each of the voice processors 20 and 30 in the second and third embodiments, and similar effects can be expected.

Although the voice processing device which is installed in a cellular phone terminal has been described as an example in the first to fourth embodiments, the invention is not limited to the configuration. The technique can be applied to any voice processing device which is installed in a voice communication device in which noise elimination exerts large influence on sound quality such as a telephone conference system or a telephone for bathroom.

In the voice processing device 3, for example, the voice processor 10 and the decoder 11 may be formed in different semiconductor chips. The voice processing device 3 may be included as a semiconductor device such as an SIP (System In Package) in which the voice processor 10, the decoder 11, and the receiver 12 are sealed in one package.

Although the case where each of the functional units in the voice processors 10, 20, and 30 is realized by a program process which is executed by a CPU or the like has been described, the invention is not limited to the case. Each of the functional units may be realized by dedicated hardware, or a system in which program processes by dedicated hardware and software fixedly exist.

What is claimed is:

1. A semiconductor device comprising:

a decoder which decodes an encoded input signal to form a decoded input signal;

a determining unit which determines whether or not a voice signal is included in the decoded input signal;

a suppression processor which performs a suppressing process for suppressing a noise component included in the decoded input signal on the basis of a result of determination by the determining unit;

a first storage for storing, as a determination criterion value used for the determination, a first criterion value which specifies the proportion of a voice signal with respect to voice distortion noise;

a second storage for storing, as a determination criterion value for determination by the determining unit, a second criterion value which specifies the proportion of a voice signal with respect to background noise; and a selector which selects the smaller of the first criterion value stored in the first storage and the second criterion value stored in the second storage, wherein the voice distortion noise is different from the background noise; and wherein the determining unit makes the determination using the criterion value selected by the selector.

2. The semiconductor device according to claim 1, further comprising an updater which calculates the second criterion value on the basis of a signal level of background noise included in the decoded input signal and updates the value in the second storage.

3. The semiconductor device according to claim 1, wherein:

in the case where the signal level of the decoded input signal is higher than a determination threshold determined on the basis of the determination criterion value, the determining unit determines that a voice signal is included in the decoded input signal, and in the case where the signal level of the decoded input signal is lower than the determination threshold, the determining unit determines that no voice signal is included in the decoded input signal.

4. The semiconductor device according to claim 1, wherein the suppressor performs:

(i) a process for suppressing the background noise on a decoded input signal determined by the determining unit contain a voice signal; and (ii) a process for suppressing voice distortion noise in the decoded input signal.

5. The semiconductor device according to claim 4, further comprising:

a third storage for storing a third criterion value as a reference of a background noise suppression amount; and a fourth storage for storing a fourth criterion value as a reference of a suppression amount of voice distortion noise, wherein:

in the case where the determining unit determines that the decoded input signal contains a voice signal, the suppressor performs a process of subtracting, from the decoded input signal, a first suppression amount according to the third criterion value and subtracting a second suppression amount according to the fourth criterion value, and in the case where the determining unit determines that the decoded input signal does not contain a voice signal, the suppressor performs a process of subtracting, from the decoded input signal, the first suppression amount according to the third criterion value.

6. The semiconductor device according to claim 5, wherein the suppressor performs a process of subtracting the first suppression amount according to the third criterion value and the second suppression amount according to the fourth criterion value, from each of a plurality of decoded input signals containing a voice signal of voiced sound, each of said plurality of decoded input signals having first been determined by the determining unit to contain a voice signal.

7. The semiconductor device according to claim 1, wherein voice distortion noise is noise based on the encoding.

8. A voice communication device comprising:

a receiver for receiving an encoded input signal; and a semiconductor device in accordance with claim 1 configured to receive the encoded input signal received by the receiver.

9. The voice communication device according to claim 8, wherein the suppression processor further comprises an updater which calculates the second criterion value on the basis of a signal level of background noise included in the decoded input signal and updates the value in the second storage.

10. The voice communication device according to claim 8, wherein: in the case where the signal level of the decoded input signal is higher than a determination threshold determined on the basis of the determination criterion value, the determining unit determines that a voice signal is included in the decoded input signal, and in the case where the signal level of the decoded input signal is lower than the determination threshold, the determining unit determines that no voice signal is included in the decoded input signal.

11. The voice communication device according to claim 9, wherein the suppressor performs:

(i) a process for suppressing the background noise in a decoded input signal determined by the determining unit to contain a voice signal; and (ii) a process for suppressing voice distortion noise in the decoded input signal.

12. The voice communication device according to claim 11, wherein the suppression processor further comprises:

a third storage for storing a third criterion value as a reference of a background noise suppression amount; and a fourth storage for storing a fourth criterion value as a reference of a suppression amount of voice distortion noise, wherein:

in the case where the determining unit determines that the decoded input signal contains a voice signal, the suppressor performs a process of subtracting a first suppression amount according to the third criterion value and subtracting a second suppression amount according to the fourth criterion value from the decoded input signal, and in the case where the determining unit determines that the decoded input signal does not contain a voice signal, the suppressor performs a process of subtracting only the first suppression amount according to the third criterion value from the decoded input signal.

13. The voice communication device according to claim 12, wherein the suppressor performs a process of subtracting the first suppression amount according to the third criterion value and the second suppression amount according to the fourth criterion value from each of a plurality of decoded input signals containing a voice signal of voiced sound, each of said plurality of decoded input signals having first been determined by the determining unit to contain a voice signal.

14. The voice communication device according to claim 8, wherein the voice distortion noise is noise based on the encoding.

15. A semiconductor device comprising:

a decoder which decodes an encoded input signal to produce a decoded input signal;

a determining unit which determines whether or not a voice signal is included in the decoded input signal, and further determines whether the voiced signal contains voiced sound or voiceless sound;

a suppression processor which performs a suppressing process for suppressing noise included in the decoded input signal; and a storage for storing a criterion value for suppressing voice distortion noise, in noise included in the decoded input signal, which is used in the suppressing process;

wherein the voice distortion noise is different from background noise;

wherein the suppression processor suppresses voice distortion noise, only if the determining unit determines that a voice signal is included in the decoded input signal; and wherein the suppression processor suppresses background noise, whether or not the determining unit determines that a voice signal is included in the decoded input signal.

16. The semiconductor device according to claim 15, wherein the voice distortion noise is noise based on the encoding.

17. The semiconductor device according to claim 16, wherein:

the suppression processor performs a process for suppressing voice distortion noise, if the decoded input signal contains a voice signal of voiced sound; and the suppression processor does not perform a process for suppressing voice distortion noise, if the decoded input signal contains a voice signal of voiceless sound.

18. A semiconductor device comprising:

a decoder which decodes an encoded input signal to form a decoded input signal containing both voice distortion noise and background noise;

a suppression processor which suppresses a noise component included in the decoded input signal;

a first storage for storing a plurality of first criterion values, each first criterion value specifying the proportion of a voice signal with respect to a different type of voice distortion noise;

a second storage for storing a plurality of second criterion values, each second criterion value specifying the proportion a voice signal with respect to a different type of background noise;

a selector which:

in response to a selection signal corresponding to one type of voice distortion signal, receives from said first storage a selected first criterion value associated with said one type of voice distortion signal;

in response to a mode signal corresponding to one type of background noise, receives from said second storage a selected second criterion value associated with said one type of background noise; and selects the smaller of the selected first and second criterion values; and a determining unit which determines whether or not a voice signal is included in the decoded input signal, based on the smaller of the two selected values selected by the selector;

wherein:

the suppression processor suppresses voice distortion noise, only if the determining unit determines that voice signal is included in the decoded input signal; and the suppression processor suppresses background noise, whether or not the determining unit determines that voice signal is included in the decoded input signal.

19. The semiconductor device according to claim 18, comprising:

a fourth storage for storing a plurality of tables, each table comprising amounts of voice distortion noise to be suppressed in each of a plurality of frequency bands, each table corresponding to a different type of voice distortion noise; wherein the suppression processor selects a particular one of said tables for suppressing voice distortion noise, based on at least one of said selected signal and said selected first criterion value.

* * * * *